US005454610A

United States Patent [19]

Taylor et al.

[11] Patent Number: 5,454,610

[45] Date of Patent: Oct. 3, 1995

[54] DOOR SECURITY DEVICE

[76] Inventors: Joseph C. Taylor; Jack R. Taylor, both of 1400 E. Coldwater Rd., Flint, Mich. 48505

[21] Appl. No.: 216,960

[22] Filed: Mar. 24, 1994

[51] Int. Cl.[6] ..... E05C 17/54

[52] U.S. Cl. ..... 292/339; 292/DIG. 15

[58] Field of Search ..... 292/DIG. 15, 289, 292/300, 339, 338, 343; 16/350, 388

[56] References Cited

U.S. PATENT DOCUMENTS

| | | | |
|---|---|---|---|
| 3,833,963 | 9/1974 | Waters | 292/DIG. 15 X |
| 4,890,092 | 12/1989 | Grimm | 292/339 X |
| 4,958,869 | 9/1990 | Bisher | 292/339 |
| 5,008,648 | 4/1991 | Conemac | 292/339 X |
| 5,029,911 | 7/1991 | Daniels | 292/DIG. 15 X |
| 5,199,759 | 4/1993 | Anderson | 292/DIG. 15 X |

*Primary Examiner*—Peter M. Cuomo
*Assistant Examiner*—Jerry Redman

[57] ABSTRACT

A door security device comprising a floor plate and a removably interlocking member, with the floor plate having a slot for receiving a leg projection, extending at a right angle, from the removably interlocking member. The floor plate is fastened securely to the floor, in close proximity, and in the path of swing of an inwardly swinging door, so that the disposed removably interlocking member will block the door from opening at all or past a predetermined point. With a first preferred embodiment having a floor plate formed with a plurality of openings for receiving screws for securely fastening it to the floor, and a removably interlocking member having two leg projections extending at right angles, in the same direction, and parallel to each other, either of which to be engaged with the slot in the floor plate, while the other facilitates handling of the removably interlocking member.

3 Claims, 1 Drawing Sheet

DOOR SECURITY DEVICE

SUMMARY OF THE INVENTION

This invention can be summarized as a two piece door security device, comprised of a floor plate and a removably interlocking member, with the floor plate having a slot for receiving a projection extending from the removably interlocking member. The floor plate is fastened securely to the floor, in close proximity, and in the path of swing of an inwardly swinging door. When the removably interlocking member is engaged with the floor plate, it restricts the door from opening at all or past a predetermined point.

BRIEF DISCRIPTION OF THE DRAWINGS

DETAILED DISCRIPTION OF THE INVENTION

Figure 1:
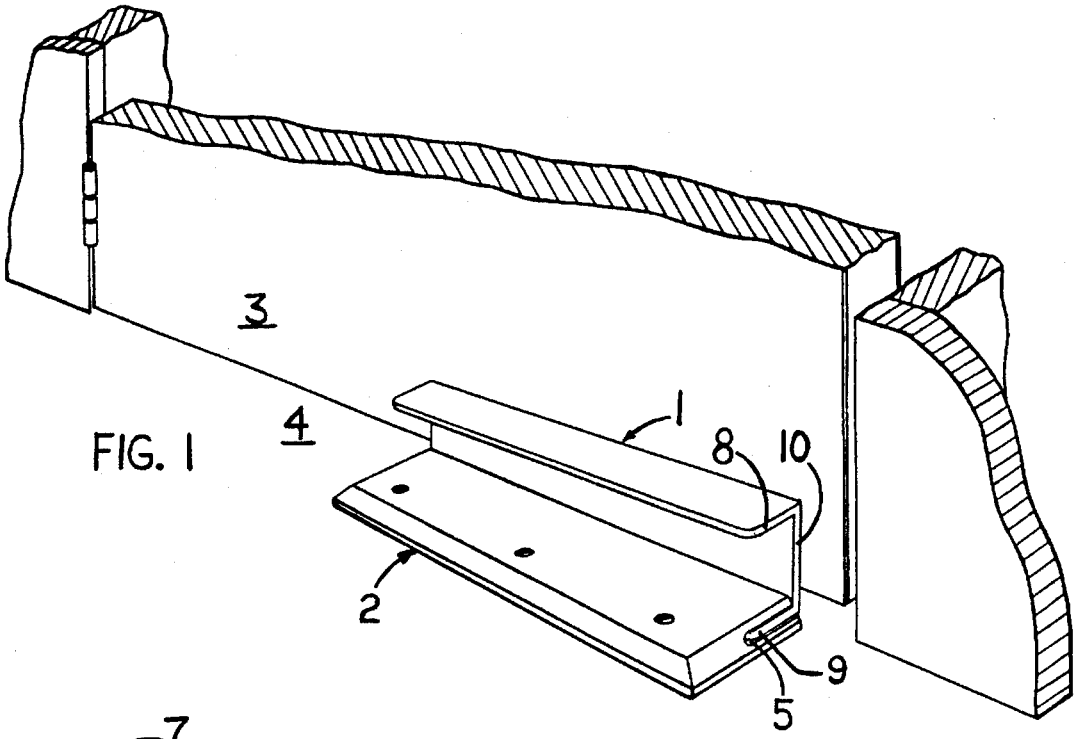
FIG. 1 is a perspective view of the preferred embodiment of the invention, securely fastened to the floor, in close proximity and in the path of swing of an inwardly swinging door.
Figure 2:
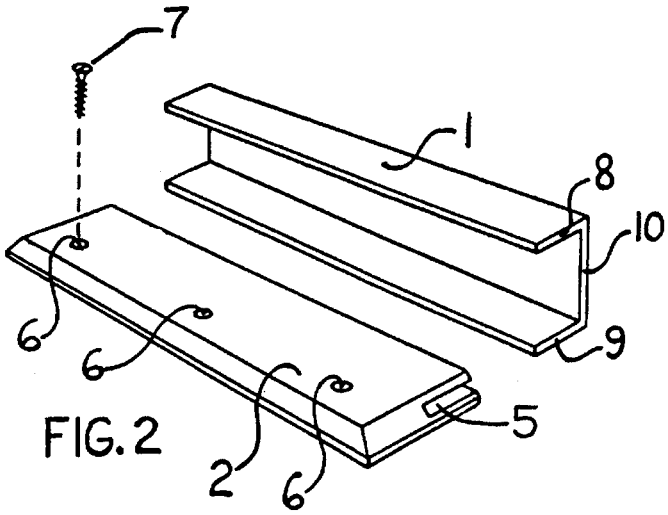
FIG. 2 shows an exploded perspective view of the invention.
Figure 3:
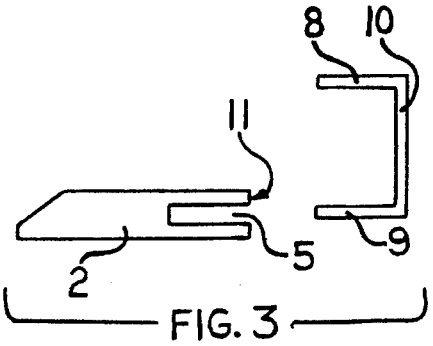
FIG. 3 is an exploded end view of the invention.
Figure 4:
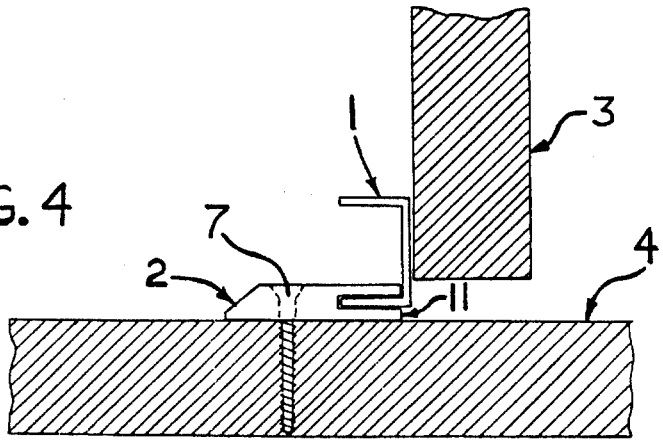
FIG. 4 shows an end view of the invention, securely fastened to the floor.

The door security device as shown in FIGS. 1–4 of the drawing sheet, consists of a lock rail 1 and a floor plate 2, each made of metal or other materials with good strength characteristics. In a preferred embodiment, the lock rail 1 is characterized as a channel shaped, removably interlocking member, having two legs 8 and 9 connected by a web 10 and approximately the same length as the floor plate 2. Leg 8 and leg 9 of the lock rail 1 are connected to the web 10 at right angles and projecting in the same direction, parallel to each other. The floor plate 2 is characterized as a flat anchor plate, having a plurality of openings 6 for receiving screws 7, which securely fasten the floor plate 2 to the floor 4 in close proximity and in the path of swing of an inwardly swinging door 3. The floor plate 2 is formed with a slot 5, on a parallel plane to the floor 4, along the entire length of the floor plate side 11 which is nearest the door 3, with the slot 5 having a width and depth capable of receiving either of the legs 8 and 9 of the lock rail 1. This facilitates interlocking of the lock rail 1 and the floor plate 2 by engaging either leg 8 or 9 of the lock rail 1 with the slot 5 from either end of the floor plate 2, with the unengaging leg 8 or 9 facilitating handling of the lock rail 1. The corresponding interlocking of the lock rail 1 with the floor plate 2 prevents movement of the lock rail 1 in the direction of opening of the door 3. Accordingly the door 3 is prevented from opening at all or past a predetermined point, depending on the placement of the floor plate 2 in relation to the door 3, assuming that the door 3 swings freely above the floor plate 2 when opened and cannot while the lock rail 1 is in place.

While the preferred embodiment of the invention has been described above, it will be recognized and understood that various modifications may be made in the invention and the appended claims are intended to cover all such modifications which may fall within the spirit and scope of the invention.

What is claimed is:

1. A door security device comprising a floor plate and a removably interlocking member;

said floor plate fastened securely to a floor in close proximity to a door and in a path of said door;

said floor plate comprising a slot extending the entire length of said floor plate wherein said slot is disposed in a horizontal plane parallel to said floor and facing said door;

in a blocking position said removably interlocking member slidably engages said slot from either end of said floor plate thereby preventing said door from opening and in a non-blocking position said removably interlocking member is removed from said floor plate by sliding said removably interlocking member from either end of said floor plate.

2. The door security device of claim 1 wherein said removably interlocking member is approximately the same length as said floor plate.

3. The door security device of claim 1 wherein said removably interlocking member comprises two legs connected by a web with said legs projecting in the same direction parallel to each other thereby allowing one of said two legs to be slidably engaged with said slot and the other of said two legs facilitates a means of handling said removably interlocking member between blocking and non-blocking positions.

* * * * *